US005457011A

United States Patent [19]

Lehr et al.

[11] Patent Number: 5,457,011

[45] Date of Patent: Oct. 10, 1995

[54] PHOTOGRAPHIC DEVELOPING COMPOSITION CONTAINING A SLUDGE INHIBITING AGENT AND USE THEREOF IN THE HIGH CONTRAST DEVELOPMENT OF NUCLEATED PHOTOGRAPHIC ELEMENTS

[75] Inventors: Gordon R. Lehr, Ashburn, Va.; Ronald J. Nothnagle, Webster, N.Y.

[73] Assignee: Eastman Kodak Company, Rochester, N.Y.

[21] Appl. No.: 346,330

[22] Filed: Nov. 29, 1994

Related U.S. Application Data

[63] Continuation of Ser. No. 173,339, Dec. 27, 1993, abandoned.

[51] Int. Cl.[6] ..... G03C 5/305

[52] U.S. Cl. ..... 430/488; 430/464; 430/481; 430/493

[58] Field of Search ..... 430/464, 481, 430/488, 493

[56] References Cited

U.S. PATENT DOCUMENTS

| | | | |
|---|---|---|---|
| 2,688,549 | 9/1954 | James et al. | 430/480 |
| 4,059,446 | 11/1977 | Hendrik et al. | 430/429 |
| 4,310,622 | 1/1982 | Onda et al. | 430/445 |
| 4,391,900 | 7/1983 | Toyoda et al. | 430/355 |
| 5,187,054 | 2/1993 | Dewanckele et al. | 430/523 |
| 5,240,823 | 8/1993 | Yamada et al. | 430/488 |

FOREIGN PATENT DOCUMENTS

| | | |
|---|---|---|
| 0223883 | 6/1987 | European Pat. Off. . |
| 0518627 | 12/1992 | European Pat. Off. . |

*Primary Examiner*—Hoa Van Le
*Attorney, Agent, or Firm*—Alfred P. Lorenzo

[57] ABSTRACT

An improved photographic developing composition, for use in development of a black-and-white silver halide photographic element, is comprised of at least one developing agent and, in an amount sufficient to inhibit sludge deposition, a polyoxyalkylated phosphate ester. The developing composition is broadly useful in black-and-white development but is most advantageously employed in a process for forming a high-contrast image utilizing a silver halide photographic element comprising a hydrazine compound which functions as a nucleating agent and an amino compound which functions as an incorporated booster.

17 Claims, No Drawings

PHOTOGRAPHIC DEVELOPING COMPOSITION CONTAINING A SLUDGE INHIBITING AGENT AND USE THEREOF IN THE HIGH CONTRAST DEVELOPMENT OF NUCLEATED PHOTOGRAPHIC ELEMENTS

This is a Continuation of U.S. application Ser. No. 173,339, filed 27 Dec. 1993.

FIELD OF THE INVENTION

This invention relates in general to photography and in particular to the development of silver halide photographic elements. More specifically, this invention relates to an improved black-and-white photographic developing composition and to use of such composition in an improved process for the development of nucleated silver halide photographic elements which are capable of high-contrast development and, in consequence, are especially useful in the field of graphic arts.

BACKGROUND OF THE INVENTION

In the development of black-and-white silver halide photographic elements a commonly encountered problem is the accumulation of "sludge" or "dirt" in the developing composition. While the mechanisms whereby such sludge is formed are varied and complex, an important contributing factor is the presence in developing compositions of compounds such as sulfites which dissolve silver halides and form silver complexes. The silver complexes that are extracted from the photographic element into the developing composition are reduced by other components of the developing composition and converted to extremely fine particles of metallic silver which are commonly referred to in the art as "silver sludge." The formation of this silver sludge is a particularly serious problem when the photographic elements are processed in an automatic processing apparatus. Thus, for example, it is common for the sludge to attach to the walls of the developing tank and/or the rollers of an automatic processor and the particles can subsequently transfer to the photographic element. The result can manifest itself as black silver specks or silver stain and, if sufficiently severe, this can render the photographic element useless for its intended purpose. The problem can be alleviated to some extent by frequent cleaning of the processing equipment to remove accumulated silver sludge, but this adds significantly to the effort and expense of the processing operation.

The problem of reducing or avoiding the deposition of silver sludge has been a very longstanding problem in the photographic art. A wide variety of compounds has been proposed heretofore as sludge-inhibiting agents. Their effectiveness for this purpose is often insufficient. Moreover, agents used to reduce sludge formation can have unwanted side effects such as suppressing development or adversely affecting the contrast of the photographic element.

Sulfites are very commonly used in black-and-white developing compositions where they serve to extend the life of the developing composition by protecting it against aerial oxidation. While they are a major contributor to sludge formation they are not the only one. Thus, for example, other common components of developing compositions such as thiosulfates and thiocyanates also dissolve silver halide and form silver complexes. Other factors contributing to sludge formation include the throughput of sensitized material, the replenishment rate and the design of the processing apparatus. Generally speaking, most, if not all, black-and-white developing compositions suffer from the problem of sludge formation, although the degree to which it occurs varies widely depending upon both the components of the developing composition and the composition of the photographic element being processed.

U.S. Pat. No. 4,975,354 issued Dec. 4, 1990, entitled "Photographic Element Comprising An Ethyleneoxy-Substituted Amino Compound And Process Adapted To Provide High Contrast Development", by Harold I. Machonkin and Donald L. Kerr, describes silver halide photographic elements having incorporated therein a hydrazine compound which functions as a nucleator and an amino compound which functions as an incorporated booster. Such elements provide a highly desirable combination of high photographic speed, very high contrast and excellent dot quality, which renders them very useful in the field of graphic arts. Moreover, since they incorporate the booster in the photographic element, rather than using a developing solution containing a booster, they have the further advantage that they are processable in conventional, low cost, rapid-access developers.

Other patents describing silver halide photographic elements comprising a hydrazine compound which functions as a nucleator and an amino compound which functions as an incorporated booster include U.S. Pat. Nos. 4,914,003 and 5,030,547.

Nucleated high-contrast photographic elements of the type described hereinabove are particularly prone to the formation of silver sludge. While the reason for this is not clearly understood, it has been a significant factor hindering the commercial utilization of such otherwise advantageous photographic elements in the field of graphic arts.

The present invention is directed toward the objective of providing an improved developing composition, useful with a wide variety of black-and-white silver halide photographic elements, that has less tendency to sludge deposition than developing compositions utilized heretofore. It is a particular objective of the invention to provide an improved process for developing high contrast photographic elements, containing a hydrazine compound which functions as a nucleator and an amino compound which functions as an incorporated booster, utilizing the improved black-and-white developing composition of this invention.

SUMMARY OF THE INVENTION

This invention provides a photographic developing composition, for use in development of a black-and-white silver halide photographic element, which comprises at least one developing agent and, in an amount sufficient to inhibit sludge deposition, a polyoxyalkylated phosphate ester.

It is preferred that the polyoxyalkylated phosphate ester employed in this invention has a molecular weight of at least 300 and preferably in the range of 500 to 4000. Oxyalkylene groups present in the phosphate ester are preferably oxyethylene and/or oxypropylene groups.

It is especially preferred that the polyoxyalkylated phosphate ester employed in this invention is a compound of the formula:

$$[R-O-(CH_2CH_2O)_m-(\overset{\overset{\displaystyle CH_3}{|}}{CH_2CHO})_n]_x-\overset{\overset{\displaystyle O}{||}}{P}-(OR^1)_{3-x}$$

wherein R is an alkyl group of 8 to 24 carbon atoms, m is 1 to 10 n is 1 to 10 x is 1 or 2

$R^1$ is hydrogen or an alkali metal.

The invention also includes within its scope a process for forming a high-contrast photographic image comprising the steps of (1) imagewise exposing a silver halide photographic element and (2) developing the exposed element with a developing composition, wherein the photographic element contains a hydrazine compound which functions as a nucleating agent and an amino compound which functions as an incorporated booster and wherein the developing composition comprises at least one developing agent and, in an amount sufficient to inhibit sludge deposition, a polyoxyalkylated phosphate ester.

The developing compositions of this invention are useful for forming black-and-white silver images by development of light-sensitive silver halide photographic elements of many different types, including, for example, microfilms, aerial films and X-ray films. They are especially useful in the field of graphic arts for forming very high contrast silver images. In the graphic arts field, they can be used with a wide variety of graphic arts films in addition to those specifically described in U.S. Pat. No. 4,975,354.

DESCRIPTION OF THE PREFERRED EMBODIMENTS

In the field of graphic arts, it has long been known to achieve high contrast by the use of low sulfite "lith" developers. In conventional "lith" developers, high contrast is achieved using the "lith effect" (also referred to as infectious development) as described by J. A. C. Yule in the Journal of the Franklin Institute, Vol. 239, 221–230 (1945). This type of development is believed to proceed autocatalytically. To achieve "lith effect" development, a low, but critical concentration of free sulfite ion is maintained by use of an aldehyde bisulfite adduct, such as sodium formaldehyde bisulfite, which, in effect, acts as a sulfite ion buffer. The low sulfite ion concentration is necessary to avoid interference with the accumulation of developing agent oxidation products, since such interference can result in prevention of infectious development. The developer typically contains only a single type of developing agent, namely, a developing agent of the dihydroxybenzene type, such as hydroquinone.

Photographic elements utilizing a hydrazine compound that functions as a nucleating agent are not ordinarily processed in conventional "lith" developers but in developers that contain substantially higher amounts of sulfite as described, for example, in such Patents as U.S. Pat. Nos. 4,269,929, 4,914,003, 4,975,354 and 5,030,547. Developers which contain high concentrations of sulfite are especially prone to the deposition of silver sludge.

The novel photographic developing composition of this invention includes at least one of the conventional developing agents utilized in black-and-white processing. Such developing agents include dihydroxybenzene developing agents, ascorbic acid developing agents, aminophenol developing agents, and 3-pyrazolidone developing agents.

The dihydroxybenzene developing agents which can be employed in the developing compositions of this invention are well known and widely used in photographic processing. The preferred developing agent of this class is hydroquinone. Other useful dihydroxybenzene developing agents include:

chlorohydroquinone,
bromohydroquinone,
isopropylhydroquinone,
toluhydroquinone,
methylhydroquinone,
2,3-dichlorohydroquinone,
2,5-dimethylhydroquinone,
2,3-dibromohydroquinone,
1,4-dihydroxy-2-acetophenone-2,4-dimethylhydroquinone
2,5-diethylhydroquinone,
2,5-di-p-phenethylhydroquinone,
2,5-dibenzoylaminohydroquinone,
2,5-diacetaminohydroquinone, and the like.

Ascorbic acid developing agents have been utilized heretofore in a wide variety of photographic developing processes. Thus, for example, U.S. Pat. Nos. 2,688,548 and 2,688,549 disclose developing compositions containing ascorbic acid developing agents and 3-pyrazolidone developing agents; U.S. Pat. No. 3,022,168 discloses developing compositions containing ascorbic acid developing agents and activating developers such as N-methyl-p-aminophenol; U.S. Pat. No. 3,512,981 discloses developing compositions containing a dihydroxybenzene developing agent such as hydroquinone, a sulfite and an ascorbic acid developing agent; U.S. Pat. No. , 3,870,479 discloses a lithographic-type diffusion transfer developer containing an ascorbic acid developing agent; U.S. Pat. No. 3,942,985 describes developing solutions containing an ascorbic acid developing agent and an iron chelate developer; U.S. Pat. Nos. 4,168,977, 4,478,928 and 4,650,746 disclose the use of an ascorbic acid developing agent in processes in which a high contrast photographic element is developed in the presence of a hydrazine compound; U.S. Pat. Nos. 4,839,259 and 4,997,743 disclose high contrast photographic elements containing a hydrazine compound and an incorporated ascorbic acid developing agent, and U.S. Pat. No. 4,975,354 discloses the use of an ascorbic acid developing agent in developing high contrast photographic elements containing both a hydrazine compound that functions as a nucleating agent and an amino compound that functions as an incorporated booster.

By the term "an ascorbic acid developing agent", as used herein, it is intended to include ascorbic acid and the analogues, isomers and derivatives thereof which function as photographic developing agents. Ascorbic acid developing agents are very well known in the photographic art (see the references cited hereinabove) and include, for example, the following compounds:

L-ascorbic acid
D-ascorbic acid
L-erythroascorbic acid
D-glucoascorbic acid
6-desoxy-L-ascorbic acid
L-rhamnoascorbic acid
D-glucoheptoascorbic acid
imino-L-erythroascorbic acid
imino-D-glucoascorbic acid
imino-6-desoxy-L-ascorbic acid
imino-D-glucoheptoascorbic acid
sodium isoascorbate
L-glycoascorbic acid
D-galactoascorbic acid
L-araboascorbic acid sorboascorbic acid sodium ascorbate and the like.

Developing compositions which utilize a primary developing agent, such as a dihydroxybenzene developing agent or an ascorbic acid developing agent, frequently also contain an auxiliary super-additive developing agent. Examples of useful auxiliary super-additive developing agents are aminophenols and 3-pyrazolidones.

The auxiliary super-additive developing agents which can be employed in the developing compositions of this invention are well known and widely used in photographic processing. As explained in Mason, "Photographic Processing Chemistry", Focal Press, London, 1975, "super-additivity" refers to a synergistic effect whereby the combined activity of a mixture of two developing agents is greater than the sum of the two activities when each agent is used alone in the same developing solution (Note especially the paragraph entitled, "Superadditivity" on Page 29 of Mason).

For the purposes of this invention, the preferred auxiliary super-additive developing agents are the 3-pyrazolidone developing agents. Particularly preferred developing agents of this class are those represented by the formula:

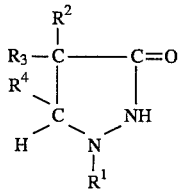

in which $R^1$ is aryl (including substituted aryl) and $R^2$, $R^3$, and $R^4$ are hydrogen or alkyl (including substituted alkyl). Included within the definition of $R^1$ are phenyl and phenyl substituted with groups such as methyl, chloro, amino, methylamino, acetylamino, methoxy and methylsulfonamidoethyl. Included within the definition of $R^2$, $R^3$ and $R^4$ are unsubstituted alkyl and alkyl substituted with groups such as hydroxy, carboxy, or sulfo. The most commonly used developing agents of this class are 1-phenyl-3-pyrazolidone, 1-phenyl-4,4-dimethyl-3-pyrazolidone, 1-phenyl-4-methyl-4-hydroxymethyl-3-pyrazolidone and 1-phenyl-4,4-dihydroxymethyl-3-pyrazolidone. Other useful 3-pyrazolidone developing agents include:

1-phenyl-5-methyl-3-pyrazolidone, 1-phenyl-4,4-diethyl-3-pyrazolidone, 1-p-aminophenyl-4-methyl-4-propyl-3-pyrazolidone, 1-p-chlorophenyl-4-methyl-4-ethyl-3-pyrazolidone, 1-p-acetamidophenyl-4,4-diethyl-3-pyrazolidone, 1-p-betahydroxyethylphenyl-4,4-dimethyl-3-pyrazolidone, 1-p-hydroxyphenyl-4,4-dimethyl-3-pyrazolidone, 1-p-methoxyphenyl-4,4-diethyl-3-pyrazolidone, 1-p-tolyl-4,4-dimethyl-3-pyrazolidone, and the like.

Less preferred but also useful auxiliary super-additive developing agents for use in the aqueous alkaline developing compositions of this invention are aminophenols. Examples of useful aminophenols include:

p-aminophenol o-aminophenol

N-methylaminophenol 2,4-diaminophenol hydrochloride

N-(4-hydroxyphenyl)glycine p-benzylaminophenol hydrochloride 2,4-diamino-6-methylphenol 2,4-diaminoresorcinol (beta-hydroxyethyl)-p-aminophenol, and the like.

More than one primary developing agent can be used in the developing compositions of this invention. For example, the developing composition can contain two different dihydroxybenzene developing agents or two different ascorbic acid developing agents or both a dihydroxybenzene developing agent and an ascorbic acid developing agent. More than one auxiliary super-additive developing agent can be included in the developing compositions of this invention. For example, the developing compositions can contain two different aminophenol developing agents or two different 3-pyrazolidone developing agents or both an aminophenol developing agent and a 3-pyrazolidone developing agent.

In addition to at least one developing agent, the novel photographic developing compositions of this invention include a polyoxyalkylated phosphate ester whose function is to inhibit sludge deposition.

As explained hereinabove, the preferred polyoxyalkylated phosphate esters have a molecular weight of at least 300 and preferably a molecular weight in the range of from 500 to 4000 and the most preferred polyoxyalkylated phosphate esters are compounds of the formula:

$$[R-O-(CH_2CH_2O)_m-(CH_2\overset{\overset{CH_3}{|}}{C}HO)_n]_x-\overset{\overset{O}{\|}}{P}-(OR^1)_{3-x}$$

wherein R is an alkyl group of 8 to 24 carbon atoms, such as octyl, decyl, dodecyl, pentadecyl or octadecyl, m is 1 to 10 n is 1 to 10 x is 1 or 2

$R^1$ is hydrogen or an alkali metal such as lithium, sodium or potassium.

As indicated by the above formula, the preferred polyoxyalkylated phosphate esters comprise a mixture of oxyethylene and oxypropylene groups.

The polyoxyalkylated phosphate esters that are utilized in this invention are well known commercially available materials that are commonly used as industrial cleaning compounds. A specific example of a commercially available material of this type is the polyoxyalkylated phosphate ester available from BASF CORPORATION under the trademark KLEARFAC AA-270.

Mixtures of two or more polyoxyalkylated phosphate esters can be usefully employed in accordance with this invention.

In the developing compositions of this invention, the polyoxyalkylated phosphate ester is typically employed in an amount sufficient to provide a concentration of from about 0.2 to about 10 grams per liter of working strength developing solution, more preferably from about 0.4 to about 4 grams per liter and most preferably from about 0.5 to about 1 grams per liter. The optimum amount to be used will depend upon both the other components of the developing composition and the particular photographic element which is to be processed as well as on the particular polyoxyalkylated phosphate ester utilized. It should be understood that the invention contemplates use of the polyoxyalkylated phosphate ester in any amount sufficient to inhibit sludge deposition.

The present invention is most effectively employed in conjunction with the use of an in-line filter through which the developing solution is recirculated. While applicants do not wish to be bound by any theoretical explanation of the manner in which their invention functions, it is believed that the polyoxyalkylated phosphate ester functions in the developing solution to precipitate silver particles and/or silver complexes so that they can subsequently be removed by an in-line filter. Suitable filters for this purpose are those having a pore size in the range of from about 2 to about 50 micrometers. The overall effect of utilizing the polyoxyalkylated phosphate ester in conjunction with the in-line filter is to render the developing solution cleaner working.

In the practice of this invention, the polyoxyalkylated phosphate ester is preferably added to the developing solution just prior to use or added intermittently during operation of the processor.

In addition to one or more developing agents and the polyoxyalkylated phosphate ester, the novel developing compositions of this invention preferably also contain a sulfite preservative.

By the term "sulfite preservative" as used herein is meant any sulfur compound that is capable of forming sulfite ions in aqueous alkaline solution. Examples of such compounds include alkali metal sulfites, alkali metal bisulfites, alkali metal metabisulfites, sulfurous acid and carbonyl-bisulfite adducts.

Examples of preferred sulfites for use in the developing solutions of this invention include sodium sulfite ($Na_2SO_3$), potassium sulfite ($K_2SO_3$), lithium sulfite ($Li_2SO_3$), sodium bisulfite ($NaHSO_3$), potassium bisulfite ($KHSO_3$), lithium bisulfite ($LiHSO_3$), sodium metabisulfite ($Na_2S_2O_5$), potassium metabisulfite ($K_2S_2O_5$), and lithium metabisulfite ($Li_2S_2O_5$).

The carbonyl-bisulfite adducts which are useful in this invention are well-known compounds. Adducts of adehydes and adducts of ketones are useful and the adlehydes employed can be monoaldehydes, dialdehydes or trialdehydes and the ketones can be monoketones, diketones or triketones. The bisulfite adducts can be adducts of alkali metal bisulfites, alkaline earth metal bisulfites or nitrogen-base bisulfites such as amine bisulfites.

Illustrative examples of the many carbonyl-bisulfite adducts which are useful in the present invention include the following compounds (all of those listed being sodium bisulfite adducts for the purpose of convenience in illustrating the invention but it being understood that the compounds can also be employed in the form of adducts of other suitable bisulfites as explained hereinabove):

sodium formaldehyde bisulfite sodium acetaldehyde bisulfite sodium propionaldehyde bisulfite sodium butyraldehyde bisulfite succinaldehyde bis-sodium bisulfite glutaraldehyde bis-sodium bisulfite beta-methyl glutaraldehyde bis-sodium bisulfite maleic dialdehyde bis-sodium bisulfite sodium acetone bisulfite sodium butanone bisulfite sodium pentanone bisulfite 2,4-pentandione bis-sodium bisulfite, and the like.

Alkaline agents whose functions is to control pH, such as carbonates, phosphates, amines or borates, are preferably also included in the developing compositions of this invention.

The amount of primary developing agent incorporated in the working strength developing solution can vary widely as desired. Typically, amounts of from about 0.05 to about 1.0 moles per liter are useful. Preferably, amounts in the range of from 0.1 to 0.5 moles per liter are employed.

The amount of auxiliary super-additive developing agent utilized in the working strength developing solution can vary widely as desired. Typically, amounts of from about 0.001 to about 0.1 moles per liter are useful. Preferably, amounts in the range of from 0.002 to 0.01 moles per liter are employed.

The amount of sulfite preservative utilized in the working strength developing solution can vary widely as desired. Typically, amounts of from about 0.05 to about 1.0 moles per liter are useful. Preferably amounts in the range of from 0.1 to 0.5 moles per liter are employed.

Working strength developing solutions prepared from the developing compositions of this invention typically have a pH in the range of from 8 to 13 and preferably in the range of from 9 to 11.5.

As indicated hereinabove, the deposition of silver sludge is a particularly serious problem with photographic elements that are processed in automatic machine processing equipment. Such devices employ numerous conveyance rollers on which silver sludge can deposit and from which it can transfer to the photographic element being processed. Automatic processing equipment utilizing conveyance rollers is very well known in the art and is described, for example, in U.S. Pat. Nos. 3,025,779 and 3,545,971.

While the essential ingredients of the novel developing composition of this invention are at least one developing agent and at least one polyoxyalkylated phosphate ester, a variety of other optional ingredients can also be advantageously included in the developing composition. For example, the developing composition can contain one or more antifoggants, antioxidants, sequestering agents, stabilizing agents or contrast-promoting agents.

Examples of particularly useful contrast-promoting agents are amino compounds as described, for example, in U.S. Pat. No. 4,269,929.

Examples of useful stabilizing agents are α-ketocarboxylic acids as described, for example, in U.S. Pat. No. 4,756,997.

In carrying out the method of this invention, it is preferred to employ one or more organic antifoggants to minimize fog formation. The organic antifoggants can be incorporated in the photographic element or they can be added to the developing solution, the essential requirement being that they be present during the developing process. Particularly advantageous results are achieved with the use of benzotriazole antifoggants. A further preferred class or organic antifoggants are the mercapto azole antifoggants. Inorganic antifoggants or restrainers, such as alkali metal bromides, can be utilized in conjunction with the use of an organic antifoggant if desired.

Particularly preferred benzotriazole antifoggants for use in the developing compositions of this invention are benzotriazole, halo-substituted benzotriazoles such as 4-chlorobenzotriazole; 4-bromobenzotriazole and 5-chlorobenzotriazole, and alkyl-substituted benzotriazoles such as 5-methylbenzotriazole.

Preferred mercapto azole antifoggants are those represented by the formula:

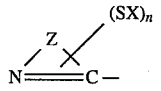

wherein Z represents the atoms necessary to complete a 5 to 6 member heterocyclic ring, such as pyrimidine, triazine, tetrazole, triazole, imidazole, diazole, oxadiazole or thiadiazole ring; and SX represents a mercapto function, n being a whole number, typically a number from 1 to about 3, any free bonds being satisfied by hydrogen atoms. In the mercapto function or group, X is a cation which includes hydrogen, an alkali metal, e.g., sodium or potassium, ammonium or an organic amine residue of such amines as triethyl amine, triethanol amine, morpholine and the like.

Mercapto tetrazole antifoggants are especially suitable in the practice of this invention and include those of the formula:

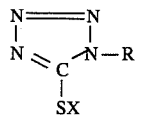

wherein R is an aliphatic or aromatic radical containing up to about 30 carbon atoms and SX is a mercapto function.

Specific examples of mercapto azole antifoggants include:

mercapto-substituted pyrimidines such as:
thiobarbituric acid and thiouracil,
mercapto-substituted oxadiazoles or thiadiazoles such as
5-phenyl-2-mercapto-1,3,4-oxadiazole and
5-o-tolyl-2-mercapto-1,3,4-thiadiazole,
mercapto triazines such as: 2,4,6-trimercapto-1,3,5-triazine,
mercapto imidazoles such as:
2-mercapto-5-phenylimidazole,
condensed imidazoles such as:
2-mercaptobenzimidazole, triazoles such as:
3,4-diphenyl-5-mercapto-1,2,4-triazole and
3-mercapto-5-methyl-1,2,4-triazole,
mercapto tetrazoles such as:
1-phenyl-5-mercaptotetrazole and
1-(3-capramido)phenyl-5-mercaptotetrazole.

In processing photographic elements with the developing compositions described herein, the time and temperature employed for development can be varied widely. Typically, the development temperature will be in the range of from about 20° C. (68° F.) to about 50° C. (122° F.), more preferably in the range of from about 25° C. (77° F.) to about 40° C. (104° F.), while the development time will be in the range of from about 10 seconds to about 150 seconds, more preferably in the range of from about 20 seconds to about 120 seconds.

The polyoxyalkylated phosphate ester utilized in this invention can be packaged together with other components of the photographic developing composition. Alternatively and preferably, it is packaged separately in the form of a concentrate by blending it with distilled water and an alkaline agent which serves to control pH. The concentrate can then be added in a suitable amount to the working strength developing solution. If desired, the concentrate can be added only after sludge deposition or silver stain is observed. To prevent bacterial growth, a biocide can be included in the concentrate. Biocides that are especially useful for this purpose are the thiazole compounds, particularly isothiazolines such as 1,2-benzisothiazolin-3-one, 2-methyl-4-isothiazolin-3-one, 2-octyl-4-isothiazolin-3-one and 5-chloro-N-methyl-4-isothiazolin-3-one.

Photographic systems depending on the conjoint action of a hydrazine compound that functions as a nucleating agent and an amino compound that functions as an incorporated booster are exceedingly complex and their successful utilization is critically dependent on being able to adequately control numerous properties including speed, contrast, dot quality, pepper fog, image spread, discrimination and practical density point. Such systems are strongly influenced not only by the composition of the photographic element but by the composition of the developing solution and by such factors as development pH, development time and development temperature.

The goal of achieving low pepper fog is one which is exceptionally difficult to achieve without sacrificing other desired properties such as speed and contrast. (The term "pepper fog" is commonly utilized in the photographic art, and refers to fog of a type characterized by numerous fine black specks). A particularly important film property is "discrimination", a term which is used to describe the ratio of the extent of shoulder development to pepper fog level. Good discrimination, i.e., full shoulder development with low pepper fog, is necessary to obtain good halftone dot quality.

Any significant level of pepper fog is highly undesirable. Image spread is an additional undesirable consequence of the autocatalytic nucleation process. Development within an area of exposure, such as a halftone dot or a line, triggers nucleation at the dot or line edge to cause the dot or line to increase in size. The nucleated development outside the original exposed area, in turn, triggers further nucleation and the growth process continues with time of development at essentially a constant rate.

Any hydrazine compound that functions as a nucleator, is capable of being incorporated in the photographic element, and is capable of acting conjointly with the incorporated booster to provide high contrast, can be used in the practice of this invention. Typically, the hydrazine compound is incorporated in a silver halide emulsion used in forming the photographic element. Alternatively, the hydrazine compound can be present in a hydrophilic colloid layer of the photographic element, preferably a hydrophilic colloid layer which is coated to be contiguously adjacent to the emulsion layer in which the effects of the hydrazine compound are desired. It can, of course, be present in the photographic element distributed between or among emulsion and hydrophilic colloid layers, such as undercoating layers, interlayers and overcoating layers.

An especially preferred class of hydrazine compounds for use in the elements of this invention are the hydrazine compounds described in Machonkin et al, U.S. Pat. No. 4,912,016 issued Mar. 27, 1990. These compounds are aryl hydrazides of the formula:

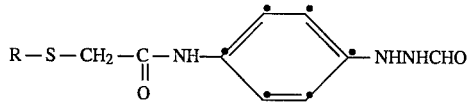

where R is an alkyl or cycloalkyl group.

Another especially preferred class of hydrazine compounds for use in the elements of this invention are the hydrazine compounds described in Looker et al, U.S. Pat. No. 5,104,769, issued Apr. 14, 1992.

The hydrazine compounds described in the aforesaid Looker et al patent have one of the following structural formulae:

I

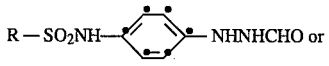

II

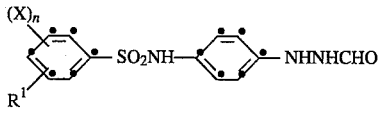

wherein:

R is alkyl having from 6 to 18 carbon atoms or a heterocyclic ring having 5 or 6 ring atoms, including ring atoms of sulfur or oxygen;

$R^1$ is alkyl or alkoxy having from 1 to 12 carbon atoms;

X is alkyl, thioalkyl or alkoxy having from 1 to about 5 carbon atoms; halogen; or —$NHCOR^2$, —$NHSO_2R^2$, —$CONR^2R^3$ or —$SO_2NR^2R^3$ where $R^2$ and $R^3$, which can be the same or different, are hydrogen or alkyl having from 1 to about 4 carbon atoms; and n is 0, 1 or 2.

Alkyl groups represented by R can be straight or branched chain and can be substituted or unsubstituted. Substituents include alkoxy having from 1 to about 4 carbon atoms, halogen atoms (e.g. chlorine and fluorine), or —$NHCOR^2$ or —$NHSO_2R^2$ where $R^2$ is as defined above. Preferred R alkyl groups contain from about 8 to about 16 carbon atoms since alkyl groups of this size impart a greater degree of insolubility to the hydrazide nucleating agents and thereby reduce the tendency of these agents to be leached during development from the layers in which they are coated into developer solutions.

Heterocyclic groups represented by R include thienyl and furyl, which groups can be substituted with alkyl having from 1 to about 4 carbon atoms or with halogen atoms, such as chlorine.

Alkyl or alkoxy groups represented by $R^1$ can be straight or branched chain and can be substituted or unsubstituted. Substituents on these groups can be alkoxy having from 1 to about 4 carbon atoms, halogen atoms (e.g. chlorine or fluorine); or —$NHCOR^2$— or —$NHSO_2R^2$ where $R^2$ is as defined above. Preferred alkyl or alkoxy groups contain from 1 to 5 carbon atoms in order to impart sufficient insolubility to the hydrazide nucleating agents to reduce their tendency to being leached out of the layers in which they are coated by developer solution.

Alkyl, thioalkyl and alkoxy groups which are represented by X contain from 1 to about 5 carbon atoms and can be straight or branched chain. When X is halogen, it may be chlorine, fluorine, bromine or iodine. Where more than one X is present, such substituents can be the same or different.

Yet another especially preferred class of hydrazine compounds are aryl sulfonamidophenyl hydrazides containing ethyleneoxy groups which have the formula:

II

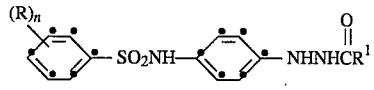

where each R is a monovalent group comprised of at least three repeating ethyleneoxy units, n is 1 to 3, and $R^1$ is hydrogen or a blocking group.

These hydrazides are described in Machonkin and Kerr, U.S. Pat. No. 5,041,355, issued Aug. 20, 1991.

Still another especially preferred class of hydrazine compounds are the compounds described in Machonkin and Kerr, U.S. Pat. No. 4,988,604 issued Jan. 29, 1991. These compounds are aryl sulfonamidophenyl hydrazides containing both thio and ethyleneoxy groups which have the formula:

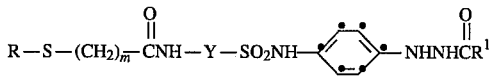

where R is a monovalent group comprised of at least three repeating ethyleneoxy units, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl.

A still further especially preferred class of hydrazine compounds are the compounds described in Looker and Kerr, U.S. Pat. No. 4,994,365, issued Feb. 19, 1991. These compounds are aryl sulfonamidophenyl hydrazides containing an alkyl pyridinium group which have the formula:

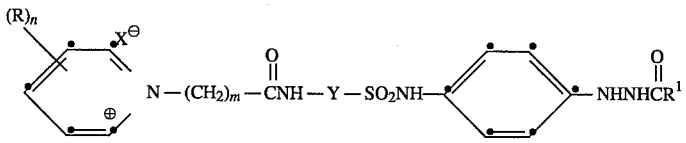

where each R is an alkyl group, preferably containing 1 to 12 carbon atoms, n is 1 to 3, X is an anion such as chloride or bromide, m is 1 to 6, Y is a divalent aromatic radical, and $R^1$ is hydrogen or a blocking group. The divalent aromatic radical represented by Y, such as a phenylene radical or naphthalene radical, can be unsubstituted or substituted with one or more substituents such as alkyl, halo, alkoxy, haloalkyl or alkoxyalkyl. Preferably, the sum of the number of carbon atoms in the alkyl groups represented by R is at least 4 and more preferably at least 8. The blocking group represented by $R^1$ can be, for example:

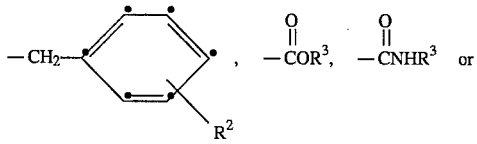

-continued

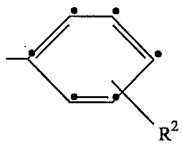

Where $R^2$ is hydroxy or a hydroxy-substituted alkyl group having from 1 to 4 carbon atoms and $R^3$ is an alkyl group having from 1 to 4 carbon atoms.

While certain preferred hydrazine compounds that are useful in this invention have been specifically described hereinabove, it is intended to include within the scope of this invention all hydrazine compound "nucleators" known to the art. Many such nucleators are described in "Development Nucleation By Hydrazine And Hydrazine Derivatives", Research Disclosure, Item 23510, Vol. 235, Nov. 10, 1983 and in numerous patents including U.S. Pat. Nos. 4,166,742, 4,168,977, 4,221,857, 4,224,401, 4,237,214, 4,241,164, 4,243,739, 4,269,929, 4,272,606, 4,272,614, 4,311,781, 4,332,878, 4,358,530, 4,377,634, 4,385,108, 4,429,036, 4,447,522, 4,540,655, 4,560,638, 4,569,904, 4,618,572, 4,619,886, 4,634,661, 4,650,746, 4,681,836, 4,686,167, 4,699,873, 4,722,884, 4,725,532, 4,737,442, 4,740,452, 4,912,016, 4,914,003, 4,975,354, 4,988,604, 4,994,365, and 5,041,355.

The hydrazine compound utilized as a nucleator in this invention is usually employed in an amount of from about 0,005 millimoles to about 100 millimoles per mole of silver and more typically from about 0.1 millimoles to about 10 millimoles per mole of silver.

The hydrazine compounds are employed in this invention in combination with negative-working photographic emulsions comprised of radiation-sensitive silver halide grains capable of forming a surface latent image and a binder. Useful silver halides include silver chloride, silver chlorobromide, silver chlorobromoiodide, silver bromide and silver bromoiodide.

Silver halide grains suitable for use in the emulsions of this invention are capable of forming a surface latent image, as opposed to being of the internal latent image-forming type. Surface latent image silver halide grains are employed in the majority of negative-working silver halide emulsions, whereas internal latent image-forming silver halide grains, while capable of forming a negative image when developed in an internal developer, are usually employed with surface developers to form direct-positive images. The distinction between surface latent image and internal latent image silver halide grains is generally well recognized in the art.

The silver halide grains, when the emulsions are used for lith applications, have a mean grain size of not larger than about 0.7 micron, preferably about 0.4 micron or less. Mean grain size is well understood by those skilled in the art, and is illustrated by Mees and James, *The Theory of the Photographic Process,* 3rd Ed., MacMillan 1966, Chapter 1, pp. 36–43. The photographic emulsions can be coated to provide emulsion layers in the photographic elements of any conventional silver coverage. Conventional silver coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain, in addition to silver halide grains, a binder. The proportion of binder can be widely varied, but typically is within the range of from about 20 to 250 grams per mol of silver halide. Excessive binder can have the effect of reducing maximum densities and consequently also reducing contrast. For contrast values of 10 or more, it is preferred that the binder be present in a concentration of 250 grams per mol of silver halide, or less.

The binders of the emulsions can be comprised of hydrophilic colloids. Suitable hydrophilic materials include both naturally occurring substances such as proteins, protein derivatives, cellulose derivatives, e.g., cellulose esters, gelatin, e.g., alkali-treated gelatin (pigskin gelatin) gelatin derivatives, e.g., acetylated gelatin, phthalated gelatin and the like, polysaccharides such as dextran, gum arabic, zein, casein, pectin, collagen derivatives, collodion, agar-agar, arrowroot, albumin and the like.

In addition to hydrophilic colloids, the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymeric materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridines, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialylaminoalkyl acrylates, vinyl imidazole copolymers, vinyl sulfide copolymers, halogenated styrene polymers, amineacrylamide polymers, polypeptides and the like.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of the invention. Typically the binders are hardened with one or more hardeners, such as those described in Paragraph VII, Product Licensing Index, Vol. 92, Dec. 1971, Item 9232, which disclosure is hereby incorporated by reference.

Emulsions according to this invention having silver halide grains of any conventional geometric form (e.g. regular cubic or octahedral crystalline form) can be prepared by a variety of techniques, e.g., single-jet, double-jet (including continuous removal techniques), accelerated flow rate and interrupted precipitation techniques, as illustrated by Trivelli and Smith, *The Photographic Journal,*Vol. LXXIX, May, 1939, pp. 330–338, T. H. James, *The Theory of the Photographic Process,* 4th Ed., MacMillan, 1977, Chapter 3; Terwilliger et al Research Disclosure, Vol. 149, September 1976, Item 14987, as well as U.S. Pat. Nos. 2,222,264; 3,650,757; 3,672,900; 3,917,485; 3,790,387; 3,761,276 and 3,979,213, and German OLS No. 2,107,118 and U. K. Patent Publications 335,925, 1,430,465 and 1,469,480, which publications are incorporated herein by reference.

It is particularly preferred that the silver halide grains are doped to provide high contrast. As is known in the art, use of a suitable doping agent, in concert with the use of a hydrazine compound that functions as a nucleator, is capable of providing an extremely high contrast response. Doping agents are typically added during the crystal growth stages of emulsion preparation, for example, during initial precipitation and/or physical ripening of the silver halide grains. Rhodium is a particularly effective doping agent, and can be incorporated in the grains by use of suitable salts such as rhodium trichloride. Rhodium-doping of the silver halide grains employed in this invention is especially beneficial in facilitating the use of chemical sensitizing agents without encountering undesirably high levels of pepper fog. Doping agents described in McDugle et al, U.S. Pat. No. 4,933,272 as being useful in graphic arts emulsions, can also be advantageously employed. These are hexacoordinated complexes of the formula:

$$[M'(NO)(L')_5]^m$$

wherein m is zero, −1, −2, or −3.

M' represents chromium, rhenium, ruthenium, osmium or iridium, and L' represents one or a combination of halide and cyanide ligands or a combination of these ligands with up to two aquo ligands.

The silver halide emulsions can be chemically sensitized with active gelatin, as illustrated by T. H. James, *The Theory of the Photographic Process,* 4th Ed., MacMillan, 1977, pp. 67–76, or with sulfur, selenium, tellurium, platinum, gold, palladium, iridium, osmium, rhenium or phosphorus sensitizers or combinations of these sensitizers, such as at pAg levels of from 5 to 10, pH levels of from 5 to 8 and temperatures of from 30° to 80° C., as illustrated by *Research Disclosure*, Vol. 134, June 1975, Item 13452. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines, (i.e., tri-, tetra- and polynuclear cyanines and merocyanines), oxonols, hemioxonols, styryls, merostyryls and streptocyanines.

A particularly preferred method of achieving chemical sensitization is by use of a combination of a gold compound and a urea compound as described in Adin, U.S. Pat. No. 5,210,002, issued May 11, 1993. This method provides exceptional results when used with high-chloride silver halide emulsions, i.e., those in which at least the surface portion of the silver halide grains is composed of more than 50 mole percent silver chloride. The combination of the gold compound and urea compound functions to enhance speed and increase contrast in the toe region of the sensitometric curve, without a concurrent increase in fog. Urea compounds effective for this purpose are 1,1,3,3-tetra-substituted middle chalcogen urea compounds in which at least one substituent comprises a nucleophilic center. A combination of potassium tetrachloroaurate and 1,3-dicarboxymethyl-1,3-dimethyl-2-thiourea is especially effective.

Chemical sensitization can also be provided by use of a combination of a gold compound and a thiourea compound as described in Adin, U.S. Pat. No. 5,213,944, issued May 25, 1993.

The photographic system to which this invention pertains is one which employs a hydrazine compound as a nucleating agent and an amino compound as an incorporated booster. Amino compounds which are particularly effective as incorporated boosters are described in Machonkin and Kerr, U.S. Pat. No. 4,975,354, issued Dec. 4, 1990.

The amino compounds useful as incorporated boosters described in U.S. Pat. No. 4,975,354 are amino compounds which:

(1) comprise at least one secondary or tertiary amino group;

(2) contain within their structure a group comprised of at least three repeating ethyleneoxy units, and (3) have a partition coefficient (as hereinafter defined) of at least one, preferably at least three, and most preferably at least four.

Included within the scope of the amino compounds utilized in this invention as incorporated boosters are monoamines, diamines and polyamines. The amines can be aliphatic amines or they can include aromatic or heterocyclic moieties. Aliphatic, aromatic and heterocyclic groups present in the amines can be substituted or unsubstituted groups. Preferably, the amino compounds employed in this invention as incorporated boosters are compounds of at least 20 carbon atoms.

Preferred amino compounds for use as incorporated boosters are bis-tertiary-amines which have a partition coefficient of at least three and a structure represented by the formula:

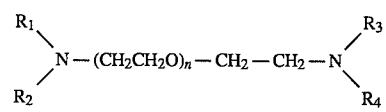

wherein n is an integer with a value of 3 to 50, and more preferably 10 to 50, $R_1$, $R_2$, $R_3$ and $R_4$ are, independently, alkyl groups of 1 to 8 carbon atoms, $R_1$ and $R_2$ taken together represent the atoms necessary to complete a heterocyclic ring, and $R_3$ and $R_4$ taken together represent the atoms necessary to complete a heterocyclic ring.

Another advantageous group of amino compounds for use as incorporated boosters are bis-secondary amines which have a partition coefficient of at least three and a structure represented by the formula:

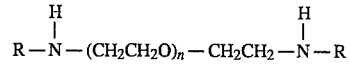

wherein n is an integer with a value of 3 to 50, and more preferably 10 to 50, and each R is, independently, a linear or branched, substituted or unsubstituted, alkyl group of at least 4 carbon atoms.

Preferably the group comprised of at least three repeating ethyleneoxy units is directly linked to a tertiary amino nitrogen atom and most preferably the group comprised of at least three repeating ethyleneoxy units is a linking group joining tertiary amino nitrogen atoms of a bis-tertiary-amino compound.

The most preferred amino compound for use in this invention as an incorporated booster is a compound of the formula:

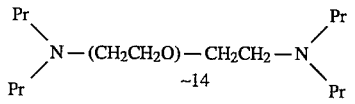

where Pr represents n-propyl.

Other amino compounds useful as incorporated boosters are described in Yagihara et al, U.S. Pat. No. 4,914,003 issued Apr. 3, 1990. The amino compounds described in this patent are represented by the formula:

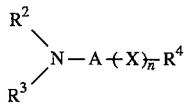

wherein $R^2$ and $R^3$ each represent a substituted or unsubstituted alkyl group or may be linked to each other to form a ring; $R^4$ represents a substituted or unsubstituted alkyl, aryl or heterocyclic group; A represents a divalent linkage; X represents —$CONR^5$—, —O—$CONR^5$, —$NR^5CONR^5$, —$NR^5COO$—, —COO—, —OCO—, —CO—, —$NR^5CO$—, —$SO_2NR^5$—, —$NR^5SO_2$—, —$SO_2$—, —S— or —O— group in which $R^5$ represents a hydrogen atom or a lower alkyl group and n represents O or 1, with the proviso that the total number of carbon atoms contained in $R^2$, $R^3$, $R^4$ and A is 20 or more.

Still other amino compounds useful as incorporated boosters are described in Katoh et al, U.S. Pat. No. 5,030,547, issued Jul. 9, 1991. The amino compounds described in this patent are represented by the formula:

$$Y_o[(A_o)_nB]_m$$

wherein $Y_o$ represents a group which promotes adsorption to silver halide, $A_o$ represents a divalent linking group, B represents an amino group, an ammonium group or a nitrogen-containing heterocyclic group, m is 1, 2 or 3 and n is 1 or 2.

The amino compound utilized as an incorporated booster is typically employed in an amount of from about 0.1 to about 25 millimoles per mole of silver, and more preferably in an amount of from about 0.5 to about 15 millimoles per mole of silver.

The term "partition coefficient", as used herein, refers to the log P value of the compound with respect to the system n-octanol/water as defined by the equation:

$$\log P = \log \frac{[X]\text{octanol}}{[X]\text{water}}$$

where X= concentration of the compound. The partition coefficient is a measure of the ability of a compound to partition between aqueous and organic phases and is calculated in the manner described in an article by A. Leo, P. Y. C. Jow, C. Silipo and C. Hansch, *Journal of Medicinal Chemistry*, Vol. 18, No. 9, pp. 865–868, 1975. Calculations for log P can be carried out using Med Chem software, version 3.54, Pomona College, Claremont, Calif. The higher the value of log P the more hydrophobic the compound. Compounds with a log P of greater than zero are hydrophobic, i.e., they are more soluble in organic media than in aqueous media, whereas compounds with a log P of less than zero are hydrophilic. A compound with a log P of one is ten times more soluble in organic media than in aqueous media, and a compound with a log P of two is one hundred times more soluble in organic media than in aqueous media.

Particularly preferred sensitizing dyes for use in this invention are the benzimidazolocarbocyanine dyes described in Adin et al, U.S. Pat. No. 5,238,779, issued Aug. 24, 1993. These dyes provide enhanced photographic sensitivity, yet leave substantially no sensitizing dye stain after rapid access processing.

The benzimidazolocarbocyanine sensitizing dyes described in the aforesaid U.S. Pat. No. 5,238,779 are benzimidazolocarbocyanine sensitizing dyes having at least one acid-substituted alkyl group attached to a nitrogen atom of a benzimidazole ring. Preferred examples of such dyes are those of the formula:

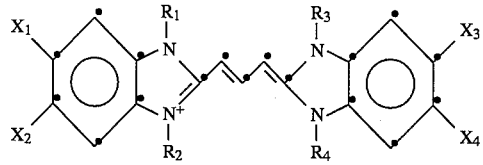

wherein $X_1$, $X_2$, $X_3$ and $X_4$ are, independently, hydrogen, cyano, alkyl, halo, haloalkyl, alkylthio, alkoxycarbonyl, aryl, carbamoyl or substituted carbamoyl, $R_1$ and $R_3$ are alkyl, and $R_2$ and $R_4$ are, independently, alkyl, alkenyl, substituted alkyl or substituted alkenyl with the proviso that at least one of $R_2$ and $R_4$ is acid-substituted alkyl and with the further proviso that when both $R_2$ and $R_4$ are acid-substituted alkyl, there is also a cation present to balance the charge.

The use of polyoxyalkylated phosphate esters to inhibit the deposition of sludge has been found to have little or no adverse effect on the speed or other sensitometric properties of the photographic element. This is the case with both nucleated elements of the type described hereinabove and with conventional non-nucleated elements.

The invention is further illustrated by the following examples of its practice.

Examples 1–3

To evaluate the performance of polyoxyalkylated phosphate esters in inhibiting sludge deposition, tests were conducted in which the photographic element described in Example 1 of U.S. Pat. No. 5,238,779 was processed in automatic processing equipment using, in a control test, a developing composition which did not contain a polyoxyalkylated phosphate ester and in a test of the invention, the same developing composition to which a polyoxyalkylated phosphate ester was added in an amount of 0,522 grams per liter of working strength developing solution. The polyoxyalkylated phosphate ester employed was obtained from BASF CORPORATION under the trademark KLEARFAC AA-270. As described in Example 1 of U.S. Pat. No. 5,238,779, the photographic element contained both a hydrazine compound which functions as a nucleating agent and an amino compound which functions as an incorporated booster.

In carrying out these tests, a developer concentrate was prepared in accordance with the following formulation:

| | |
|---|---|
| Sodium metabisulfite | 145 g |
| 45% Potassium hydroxide | 178 g |
| Diethylenetriamine pentaacetic acid pentasodium salt (40% solution) | 15 g |
| Sodium bromide | 12 g |
| Hydroquinone | 65 g |
| 1-Phenyl-4-hydroxymethyl-4-methyl-3-pyrazolidone | 2.9 g |
| Benzotriazole | 0.4 g |
| 1-Phenyl-5-mercaptotetrazole | 0.05 g |
| 50% Sodium hydroxide | 46 g |
| Boric acid | 6.9 g |
| Diethylene glycol | 120 g |
| 67% Potassium Carbonate | 120 g |
| Water to one liter | |

The concentrate was diluted at a ratio of one part of concentrate to two parts of water to produce a working strength developing solution with a pH of 10.5± 0.1.

In each of Examples 1 to 3, the working strength developing solution additionally contained 0.522 grams per liter of the polyoxyalkylated phosphate ester. In each of Examples 1 to 3 and control tests 1 to 3, the developing solution was continuously recirculated through a filter and returned to the developer tank. The filter functioned to remove sludge particles.

In both the control tests and the examples, the condition of the developing solution and processor was rated in accordance with the following cleanliness rating scale:

| Cleaniness Rating | Condition |
|---|---|
| 1 | Essentially no dirt buildup |
| 2 | Some dirt buildup but processor is usable |
| 3 | Dirt buildup is heavy but processor is usable |
| 4 | Dirt buildup is very heavy and use of processor is marginal |
| 5 | Dirt buildup is extremely heavy and processor is not usable due to sludge deposits |

The results obtained in Examples 1 to 3 and their associated controls are reported below. The difference between the examples was the use of different processing equipment, different film throughput rates and different run lengths, since the same film and the same developing solution was used in each example.

| Example | Cleanliness Rating |
|---|---|
| Control 1 | 3–4 |
| Example 1 | 1 |
| Control 2 | 2–3 |
| Example 2 | 1 |
| Control 3 | 2 |
| Example 3 | 1 |

As indicated by the above data, the polyoxyalkylated phosphate ester was very effective in inhibiting sludge deposition under a variety of processing conditions. Similar results were obtained when the tests were repeated using higher or lower concentrations of the polyoxyalkylated phosphate ester.

The invention has been described in detail, with particular reference to Certain preferred embodiments thereof, but it should be understood that variations and modifications can be effected within the spirit and scope of the invention.

We claim:

1. A photographic developing composition for use in development of a black-and-white silver halide photographic element; said composition comprising at least one developing agent and, in an amount sufficient to inhibit sludge deposition, a polyoxyalkylated phosphate ester of the formula:

$$[R-O-(CH_2CH_2O)_m-(CH_2\overset{\overset{\displaystyle CH_3}{|}}{C}HO)_n]_x-\overset{\overset{\displaystyle O}{||}}{P}-(OR^1)_{3-x}$$

wherein R is an alkyl group of 8 to 24 carbon atoms, m is 1 to 10 n is 1 to 10 x is 1 or 2

$R^1$ is hydrogen or an alkali metal.

2. A photographic developing composition as claimed in claim 1, wherein said polyoxyalkylated phosphate ester has a molecular weight of at least 300.

3. A photographic developing composition as claimed in claim 1, wherein said polyoxyalkylated phosphate ester has a molecular weight in the range of from 500 to 4000.

4. A photographic developing composition as claimed in claim 1, wherein said composition comprises a dihydroxybenzene developing agent.

5. A photographic developing composition as claimed in claim 1, wherein said composition comprises an ascorbic acid developing agent.

6. A photographic developing composition as claimed in claim 1, wherein said composition comprises a dihydroxybenzene developing agent and a 3-pyrazolidone which functions as an auxiliary super-additive developing agent.

7. A photographic developing composition as claimed in claim 1, wherein said composition comprises a dihydroxybenzene developing agent and an aminophenol which functions as an auxiliary super-additive developing agent.

8. A photographic developing composition as claimed in claim 1, wherein said composition comprises an ascorbic acid developing agent and a 3-pyrazlidone which functions as an auxilary super-additive developing agent.

9. A photographic developing composition as claimed in claim 1, wherein said composition comprises an ascorbic acid developing agent and an aminophenol which functions as an auxiliary super-additive developing agent.

10. A photographic developing composition as claimed in claim 1, wherein said composition comprises hydroquinone.

11. A photographic developing composition as claimed in claim 1, wherein said composition comprises L-ascorbic acid.

12. A photographic developing composition as claimed in claim 1, wherein said composition comprises D-ascorbic acid.

13. A photographic developing composition as claimed in claim 1, wherein said composition comprises hydroquinone and 1-phenyl-4-hydroxymethyl-4-methyl-3-pyrazolidone.

14. A photographic developing composition as claimed in claim 1, wherein said composition comprises hydroquinone and N-methylaminophenol.

15. A photographic developing composition as claimed in claim 1, additionally comprising a sulfite preservative.

16. A photographic developing composition as claimed in claim 1, where said polyoxyalkylated phosphate ester is present in an amount sufficient to provide a concentration of from about 0.5 to about 1 grams per liter of working strength developing solution.

17. A photographic developing composition for use in development of a black-and-white silver halide photographic element, said developing composition comprising:

(1) a dihydroxybenzene developing agent;

(2) an auxiliary super-additive developing agent;

(3) a sulfite preservative; and (4) a sludge-inhibiting amount of a polyoxyalkylated phosphate ester of the formula:

$$[R-O-(CH_2CH_2O)_m-(CH_2\overset{CH_3}{\overset{|}{C}}HO)_n]_x-\overset{O}{\overset{||}{P}}-(OR^1)_{3-x}$$

wherein R is an alkyl group of 8 to 24 carbon atoms, m is 1 to 10 n is 1 to 10 x is 1 or 2

$R^1$ is hydrogen or an alkali metal.

* * * * *